US006441329B2

(12) United States Patent
Guille et al.

(10) Patent No.: US 6,441,329 B2
(45) Date of Patent: Aug. 27, 2002

(54) CIRCUIT BREAKER DRIVE

(75) Inventors: Serge Guille, Essigny le Grand; Marc Burlet, Saint Quentin, both of (FR)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/731,352

(22) Filed: Dec. 6, 2000

(30) Foreign Application Priority Data

Mar. 17, 2000 (FR) ..... 00 03486

(51) Int. Cl.[7] ..... H01H 3/32
(52) U.S. Cl. ..... 200/400; 200/332
(58) Field of Search ..... 200/400, 401, 200/332, 332.1, 337, 500, 501

(56) References Cited

U.S. PATENT DOCUMENTS 2,264,990 A 12/1941 Lindstrom et al.
3,752,947 A * 8/1973 Strobel ..... 200/332
4,901,046 A 2/1990 Alsch
5,504,290 A 4/1996 Baginski et al. ..... 200/401
5,808,532 A * 9/1998 DiVincenzo et al. .... 200/400 X

FOREIGN PATENT DOCUMENTS

FR 0 427 641 A1 10/1990
FR 2 701 596 A1 2/1993

* cited by examiner

*Primary Examiner*—Renee Luebke
(74) *Attorney, Agent, or Firm*—Cantor Colburn LLP

(57) ABSTRACT

A circuit breaker drive is disclosed. The circuit breaker drive includes an actuator for assuming a plurality of positions and a lever coupled to the actuator and responsive to the action of the actuator. The circuit breaker drive also includes a cam rotatable about an axis, the cam is juxtaposed proximate the lever, and the lever is operative to rotate the cam about the axis. The circuit breaker drive further includes a rack coupled to the cam and to an operating handle of the mol circuit breaker. Rotation of the cam about the axis drives the rack to move the operating handle.

21 Claims, 16 Drawing Sheets

CIRCUIT BREAKER DRIVE

CROSS-REFERENCE TO RELATED APPLICATIONS

This application claims the benefit of the Application Number 0003486 filed Mar. 17, 2000 in France, which is incorporated herein by reference.

BACKGROUND OF THE INVENTION

This invention relates to circuit breakers and, more particularly to a circuit breaker drive for use with circuit breakers.

It is known in the art to provide circuit breakers for electrical systems. The circuit breaker is operative to disengage the electrical system under certain operating conditions. It is advantageous to provide a mechanism whereby the electrical system is reengaged remotely and with a minimum response time. The circuit breaker drive allows the circuit breaker to be operated remotely. A drive for molded case circuit breakers is described in French Patent No. 2,701,596. With the drive, the circuit breaker can be opened, closed or reset after trip. It is the fore necessary to develop a faster operating mechanism capable of reengaging the electrical system in a minimum amount of time.

BRIEF SUMMARY OF THE INVENTION

A circuit breaker drive is disclosed. The circuit breaker drive includes an actuator for assuming a plurality of positions and a lever coupled to the actuator and responsive to the action of the actuator. The circuit breaker drive also includes a cam rotatable about an axis, the cam is juxtaposed proximate the lever, and the lever is operative to rotate the cam about the axis. The circuit breaker drive further includes a rack coupled to the cam and to an operating handle of the mol circuit breaker. Rotation of the cam about the axis drives the rack to move the operating handle.

DETAILED DESCRIPTION OF THE INVENTION

Figure 1:
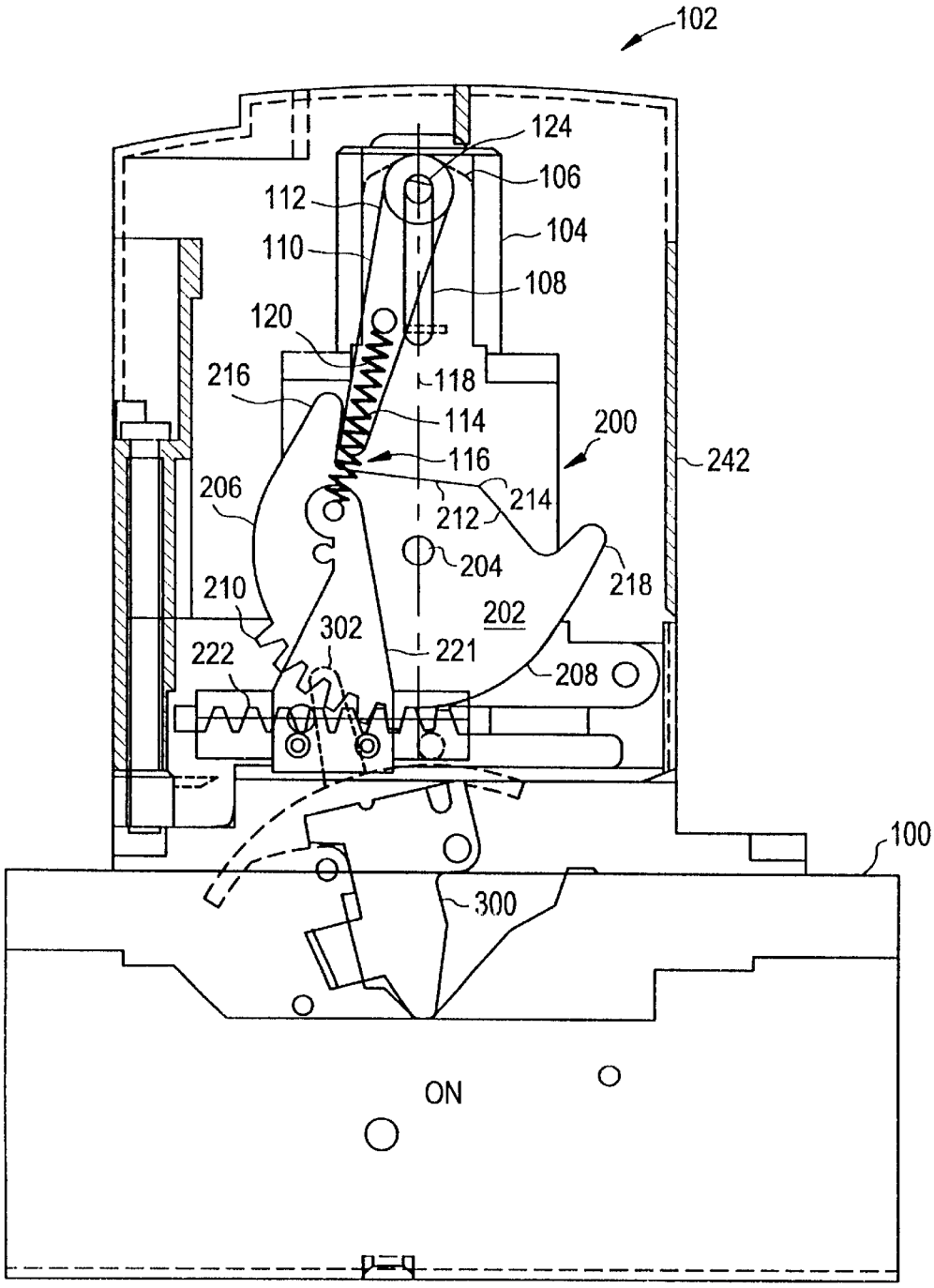
FIG. 1 is a side view of a circuit breaker drive of the present invention in the on position.

Referring now to FIGS. 1 through 6, a molded case circuit breaker (MCCB) is generally shown at 100. The components of the circuit breaker drive of the present invention are shown generally at 102. The circuit breaker drive 102 components comprise an actuator, such as a solenoid 104 including a return spring (not shown), disposed in a solenoid housing 106 and operative to successively assume one of a plurality of positions. A lever 110, such as a slidable and rotatable lever 110, is coupled to the solenoid 104 and responsive to the action thereof. A first end 112 of the lever 110 is pivotally coupled to the solenoid 104 by way of a first axis 124 disposed in a slot 108 in the solenoid housing 106. The circuit breaker drive 102 further comprises a cam system 200 proximate the lever 110. The cam system 200 is coupled to a circuit breaker operating mechanism 300 responsive to the state of an electrical system (not shown). The motion of the cam system 200, under the impetus of the lever 110 and solenoid 104, is operative to disengage and reengage a set of circuit breaker contacts (not shown) coupled to the circuit breaker operating mechanism 300. Disengagement (i.e., opening) of, the se of circuit breaker contacts interrupts the flow of electrical current through the circuit breaker, as is well known. Reengagement (i.e., closing) of the circuit breaker contacts allows electrical current to flow through the circuit breakers as is well known.

More particularly in FIG. 1, the cam system 200 comprises a cam 202 rotatable about a second axis 204. The cam 202 includes a base 206 having a first surface 208. At least one second surface 212 is disposed substantially in opposition to the first surface 208 and culminates in an apex 214. In addition, first and second flanges 216, 218 extend from the base 206. The cam system 200 further comprises a rack 220, such as a slidable rack 220, coupled to the base 206 of the cam 202. A plate 224 is affixed to the rack 220 and coupled to the layer 110 by a spring 120. A second end 114 of the lever 110 is disposed in a first position proximate the at least one second surface 212 and the first flange 216 defining a clearance 116 therebetween.

Still further in FIG. 1, the first surface 208 includes a first set of gear teeth 210 and the rack 220 includes a second set of gear teeth 222 mated to the first set of gear teeth 210. Furthermore, the circuit breaker operating mechanism 300 includes an operating handle 302 extending from the circuit breaker 100 and coupled to the rack 220. The operating handle 302 aids in effecting the aforesaid disengagement and reengagement of the circuit breaker contacts in response to the motion of the cam system 200, responding in turn to the action of the solenoid 104 and the lever 110.

It will be appreciated from FIGS. 1–6 that the lever 110, the cam system 200 and the circuit breaker operating mechanism 300 may successively assume one of a plurality of configurations in response to the change in state of an electrical system (not shown) and to the action of the solenoid 104. For example, in FIG. 1 the circuit breaker contacts are closed and the lever 110 is in an "up" position and positioned left of a centerline 118 as viewed. The second end 114 of the lever 110 is juxtaposed in close proximity to the second surface 212 and the first flange 216 whereby the cam 202, the plate 224 and the rack 220 are positioned left of the centerline 118 as viewed. The aforesaid juxtaposition of the lever 110 is such as to define the clearance 116 between the second end 114 of the lever 110 and the second surface 212. This configuration is referred to as the "ON" position.

Figure 2:
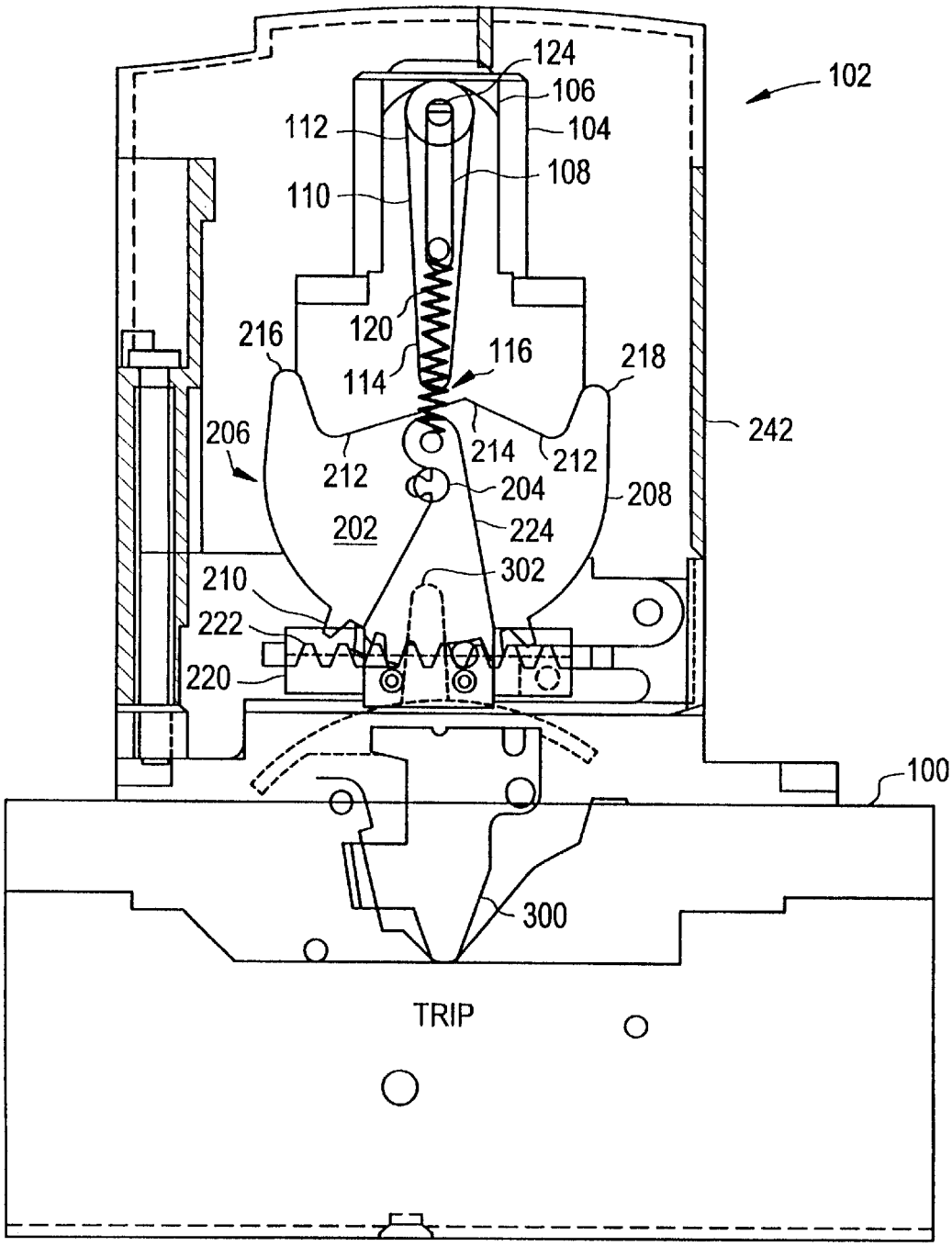
FIG. 2 is a side view of the circuit breaker drive of FIG. 1 in the TRIP position.

In FIG. 2, in response to a change in state of the electrical system, for instance in response to an overcurrent condition in the electrical system, the circuit breaker operating mechanism 300 rotates clockwise (trips) to open the contacts as is known in the art. The action of the operating mechanism 300 also forces the operating handle 302 to move clockwise. Movement of the operating handle 302 forces the lever 110, the cam 202 and the plate 224, to move so as to be essentially aligned along the centerline 118 while retaining the clearance 116. This configuration is referred to as the "TRIP" position.

Figure 3:
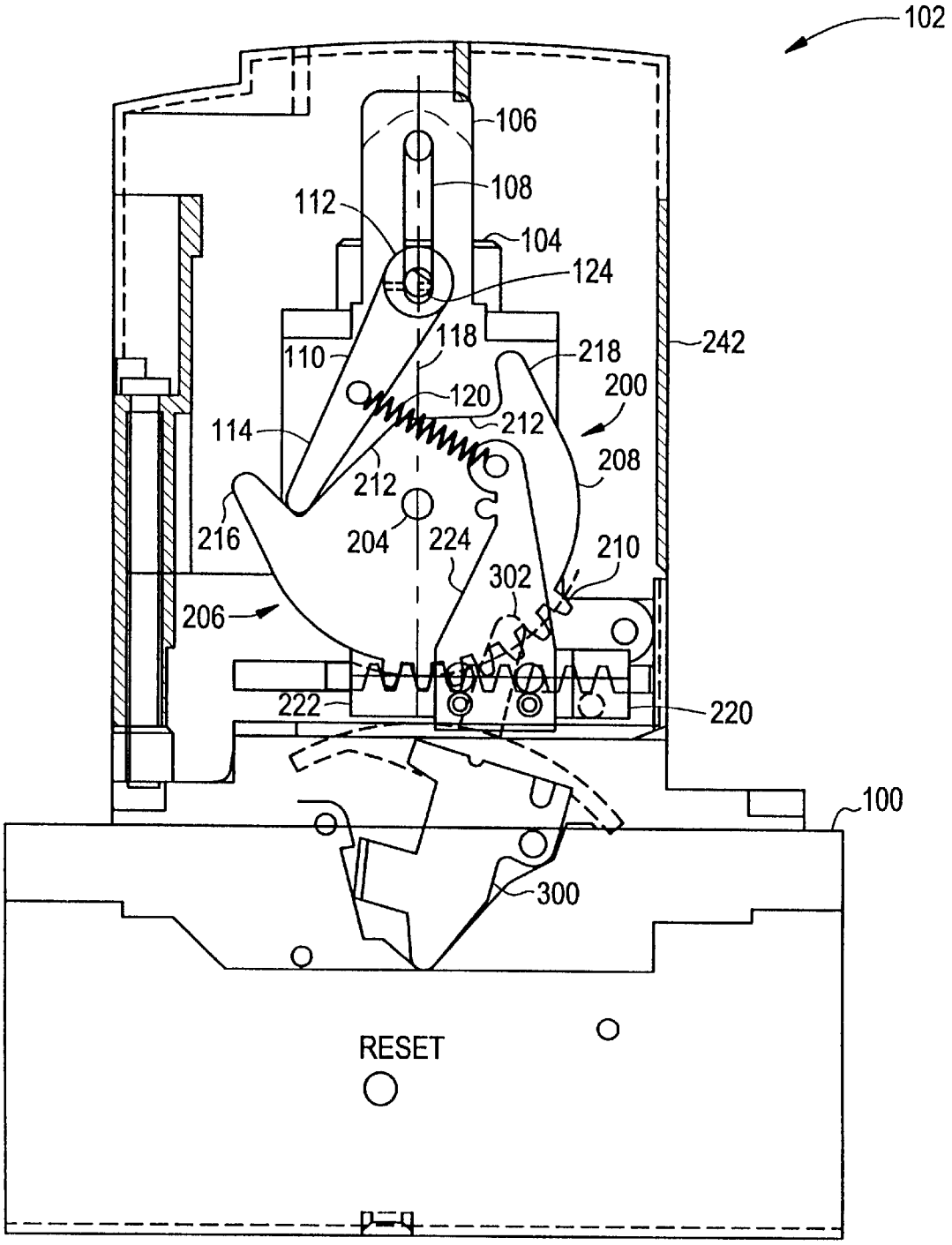
FIG. 3 is a side view of the circuit breaker drive of FIG. 1 in the RESET position.

In FIG. 3, in response to the action of the solenoid 104, the lever 110 is driven downward in the slot 108. The second end 114 of the lever 110 makes contact with the cam 202, thus rotating the cam 202 counter clockwise. This action drives the rack 220 rightward as viewed and rotates the circuit breaker operating mechanism 300 further clockwise, thus resetting the circuit breaker operating mechanism 300 after circuit breaker trip. This configuration is referred to as the "RESET" position.

Figure 4:
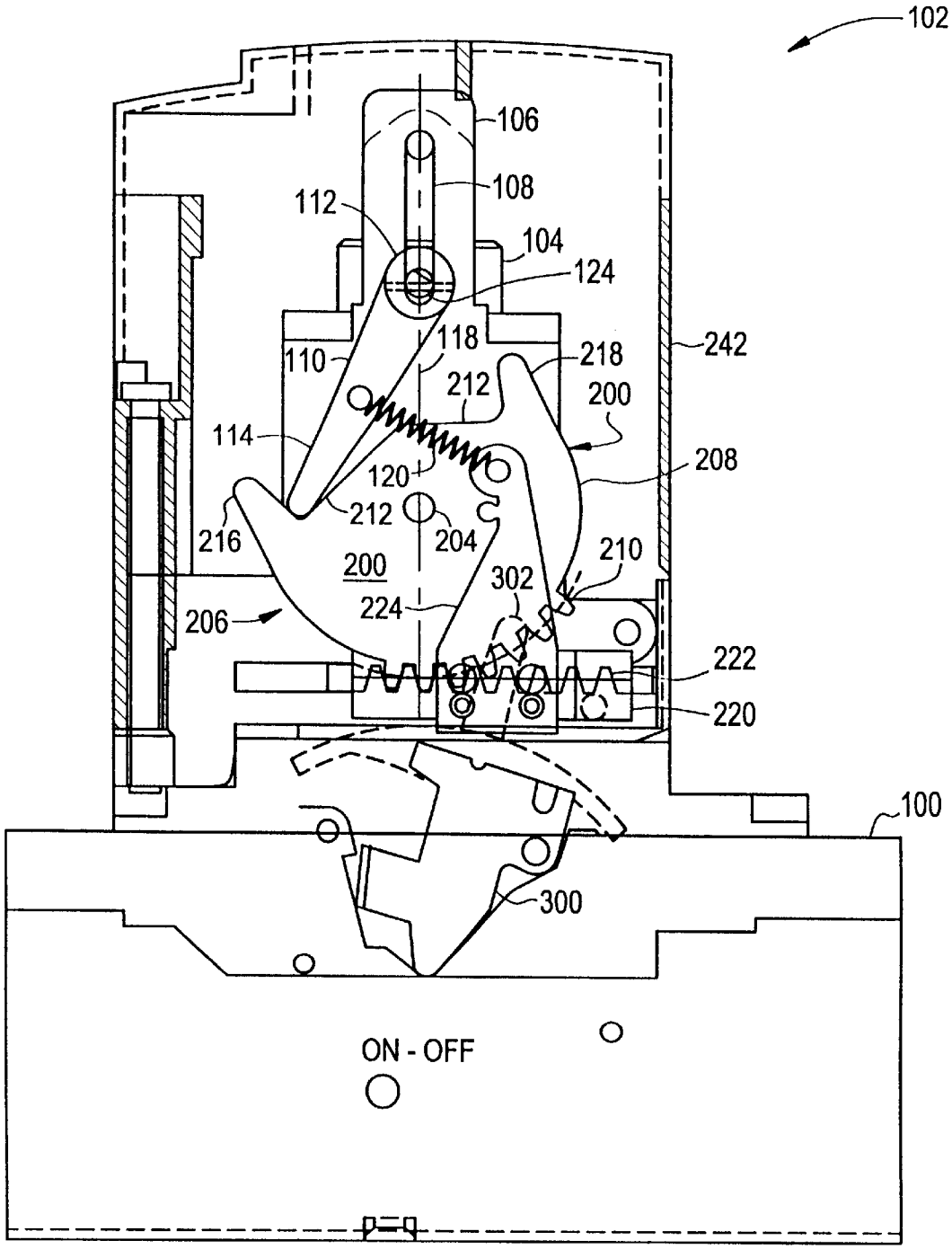
FIG. 4 is a side view of the circuit breaker drive of FIG. 1 in the ON-OFF position.

In FIG. 4 the circuit breaker drive 102 is in the same mechanical configuration as in FIG. 3. FIG. 4 represents the intermediate position of the drive 102 and when the drive 102 is moving from the ON position to the OFF position, which is described with reference to FIG. 5.

Figure 5:
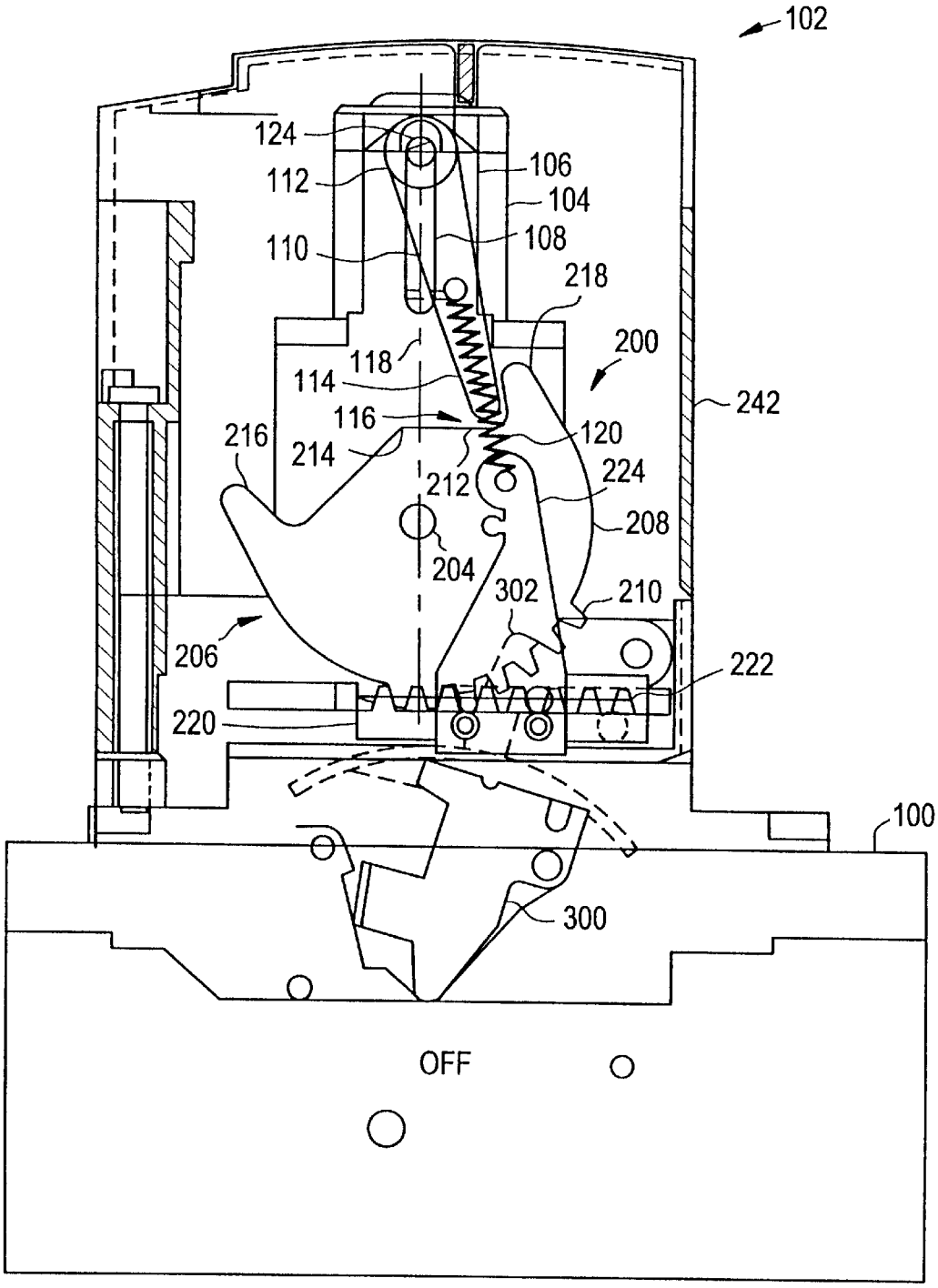
FIG. 5 is side view of the circuit breaker drive of FIG. 1 in the OFF position.

In FIG. 5, in response to the action of the solenoid 104, the lever 110 is driven upward in the slot 108 thereby positioning the lever 110 to the right of the centerline 118, as viewed, due to the spring 120. The second end 114 of the lever 110 is juxtaposed in close proximity to the second surface 212 and the second flange 218 such as to retain the aforesaid clearance 116 between the lever 110 and the second surface 212. The circuit breaker contacts are now open. This configuration is referred to as the "OFF" position.

Figure 6:
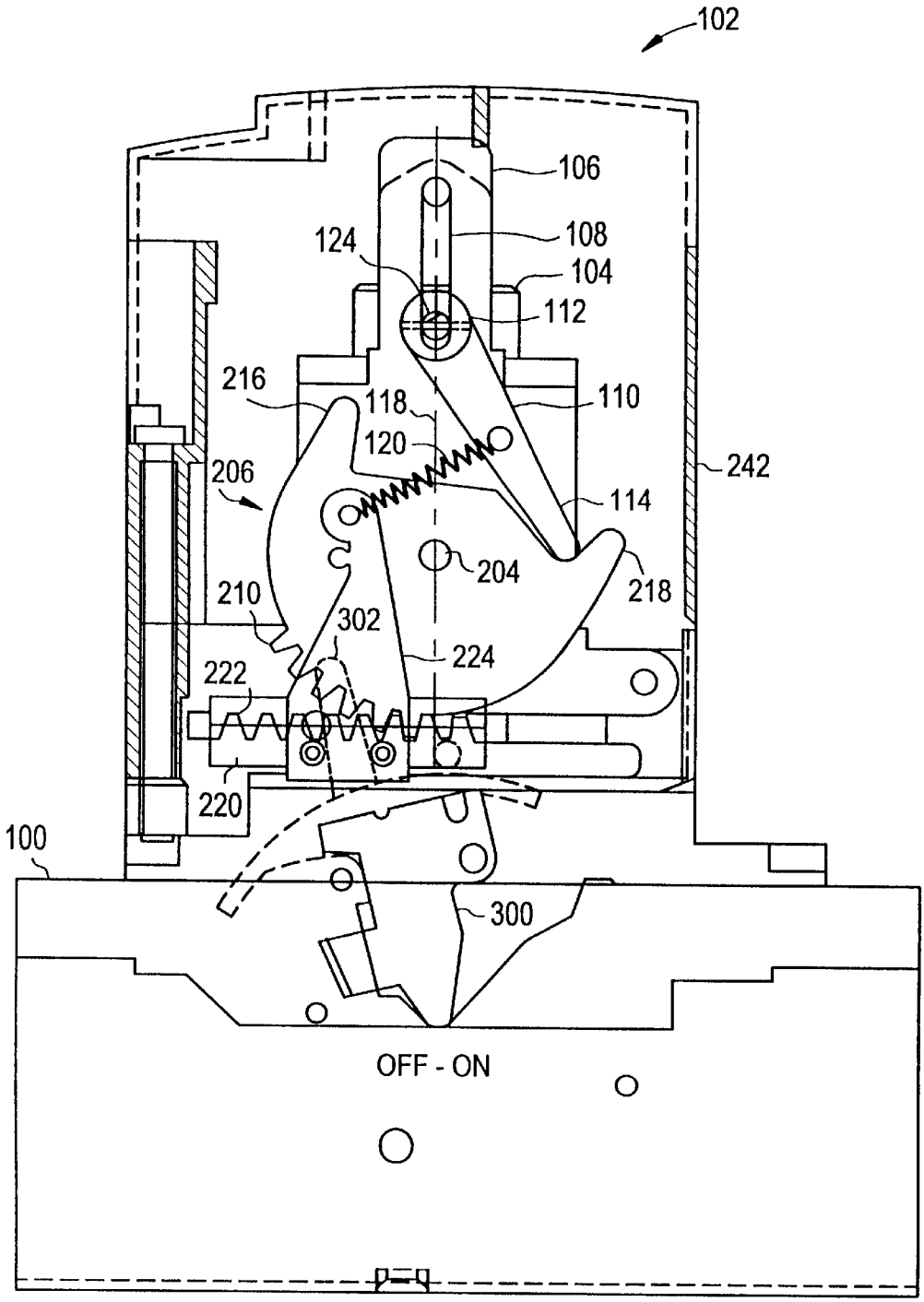
FIG. 6 is a side view of the circuit breaker drive of FIG. 1 in the OFF-ON position.

In FIG. 6, in response to the action of the solenoid 104, the lever 110 is driven downward in the slot 108. The second end 114 of the lever 110 makes contact with the cam 202, thus rotating the cam 202 clockwise. This action drives the rack 220 leftward as viewed and reengages the circuit breaker contacts. The circuit breaker contacts go from open to closed. This configuration is referred to as the "ON" position. The lever 110, the cam system 200 and the circuit breaker operating mechanism 300 are returned to the initial configuration of FIG. 1 when the lever 110 is driven upward in the slot 108 by the action of the solenoid 104.

It will be appreciated that the drive 102 may proceed directly from the "ON" position of FIG. 1 to the "OFF" position of FIG. 5 by way of the "ON-OFF" position of FIG. 4. This is accomplished under the impetus of the solenoid 104. When in the "ON" position of FIG. 1, the solenoid 104 may be actuated, thus driving the lever 110 downward in the slot 108. This action rotates the cam 202 counterclockwise and disengages the circuit breaker contacts. The solenoid 104 is returned upward in the slot 108 by the return spring (not shown), thus assuming the "OFF" position of FIG. 5. It will also be appreciated that the drive 102 may proceed directly from the "OFF" position of FIG. 5 to the "ON" position of FIG. 1 by way of the "ON-OFF" positon of FIG. 6. This is accomplished under the impetus of the solenoid 104. When in the "OFF" position of IFG. 5, the solenoid 104 may be actuated, thus driving the solenoid 104 downward in the slot 108. This action rotates tha cam 202 clockwise and reengages the circuit breaker contacts, The solenoid 104 is returned upward in the slot 108 by the return spring (not shown), thus assuming the "ON" position of FIG. 1.

It will be further appreciated that the drive 102 may instead proceed from the "ON" position of FIG. 1 to the "OFF" position of FIG. 5 by way of the "TRIP" position and the "RESET" position of FIGS. 2 and 3 respectively. In particular, whin in the "ON" position, an operatine mechanism, in response to a change in the state of the electrical system trip, will bring the drive 102 to the "TRIP" position seen in FIG. 2 with circuit breaker contacts open. The downward action of the solenoid 104 in the slot 108 rotates the cam 202 counterclockwise to the "RESET" positon of FIG. 3. The return of the solenoid 104 upward in the slot 108 by the return spring (not shown), brings the drive 102 to the "OFF" position of FIG. 5. The solenoid 104 may then be actuated, thus driving the solenoid 104 downward in the slot 108. This action rotates the cam 202 clockwise and reengages the circuit breaker contacts, The solenoid 104 is returned upward in the slot 108 by the return spring (not shown), thus assuming the "ON" position of FIG. 1.

Figure 7:
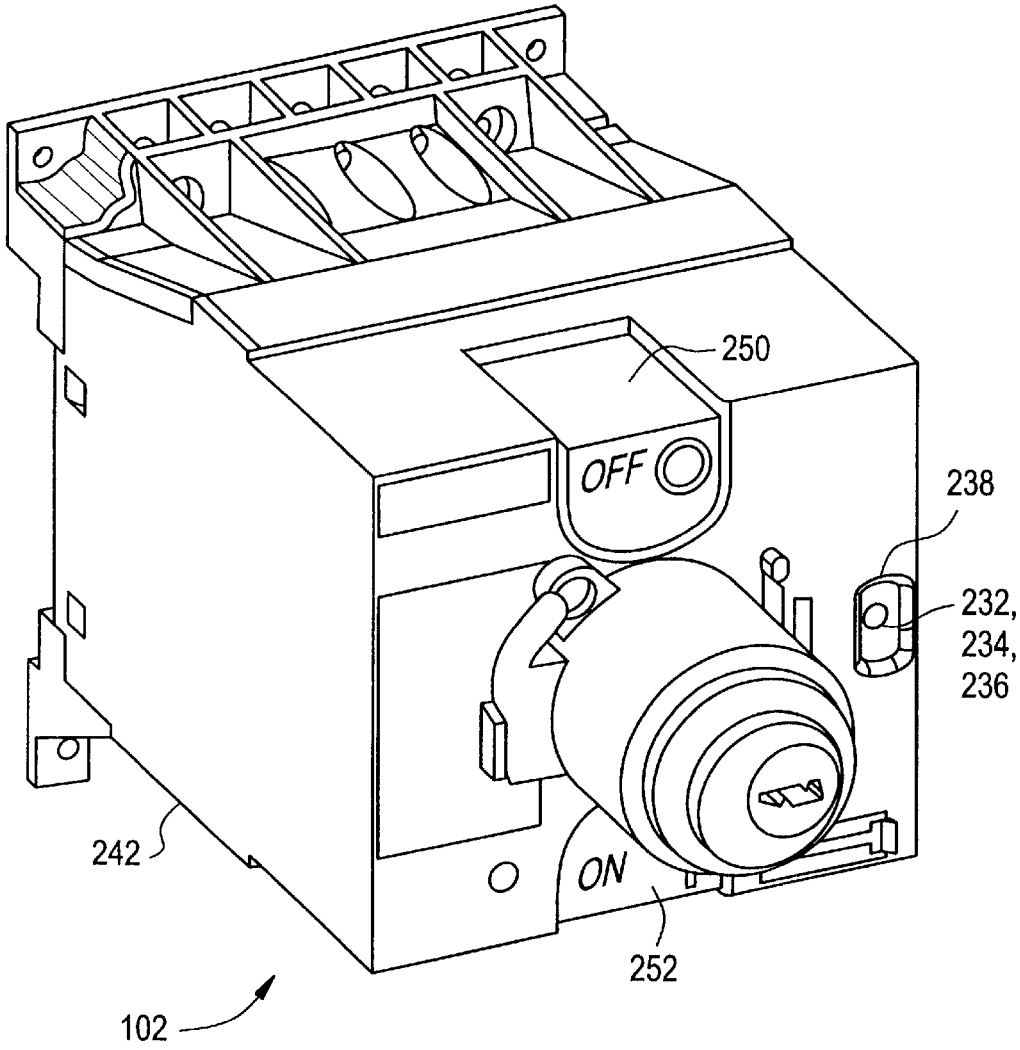
FIG. 7 is a three dimensional perspective view of an alternative embodiment of the circuit breaker drive of the preset invention.
Figure 8:
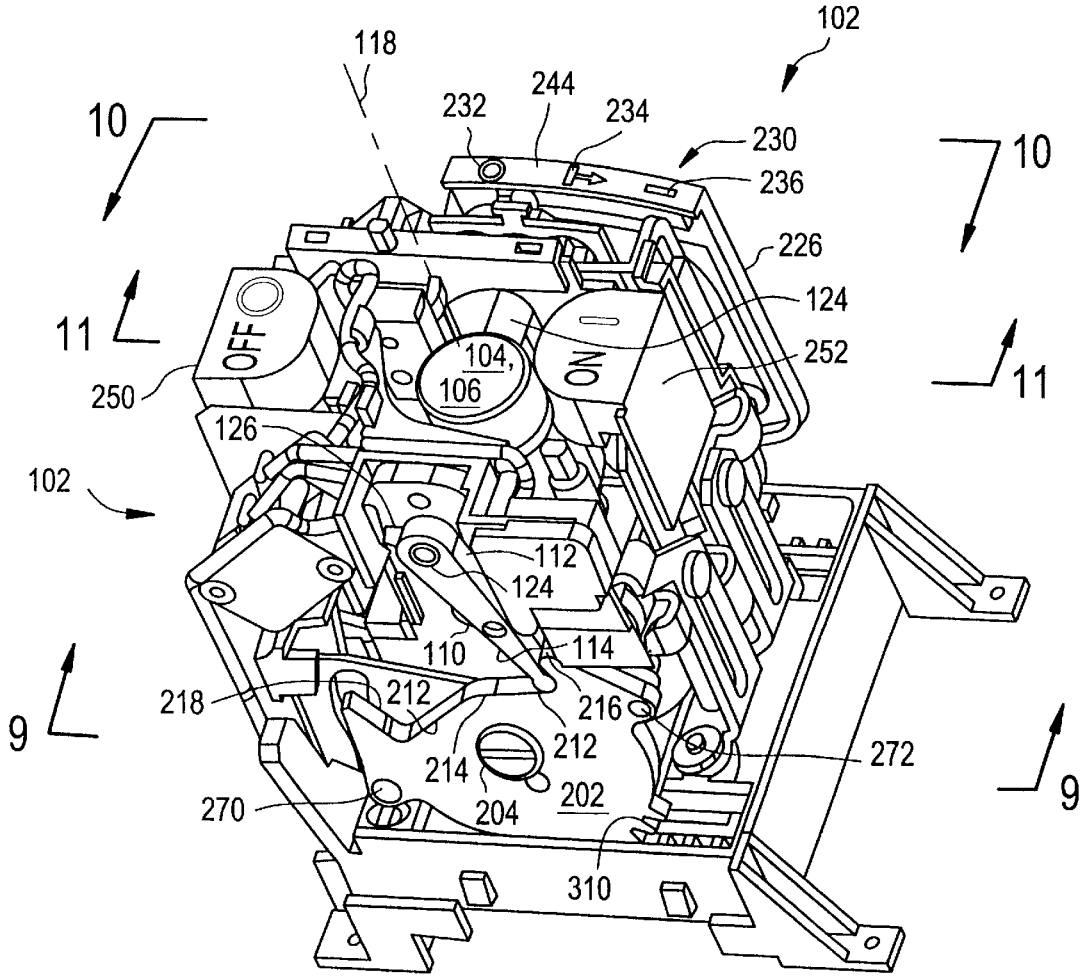
FIG. 8 is a three dimensional perspective view of the circuit breaker drive of FIG. 7 with the cover removed.
Figure 9:
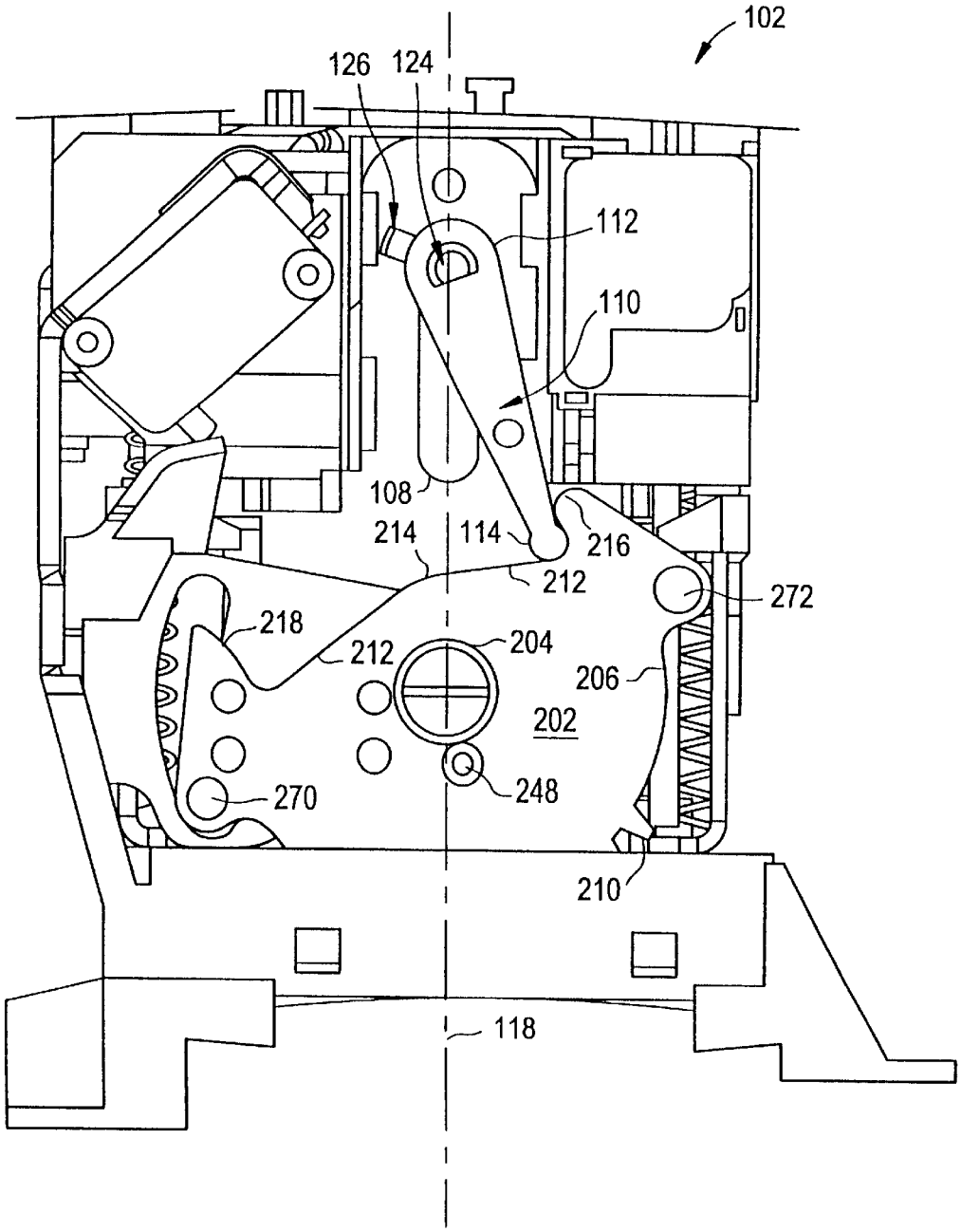
FIG. 9 is a left side view of the circuit breaker drive of FIG. 8.
Figure 10:
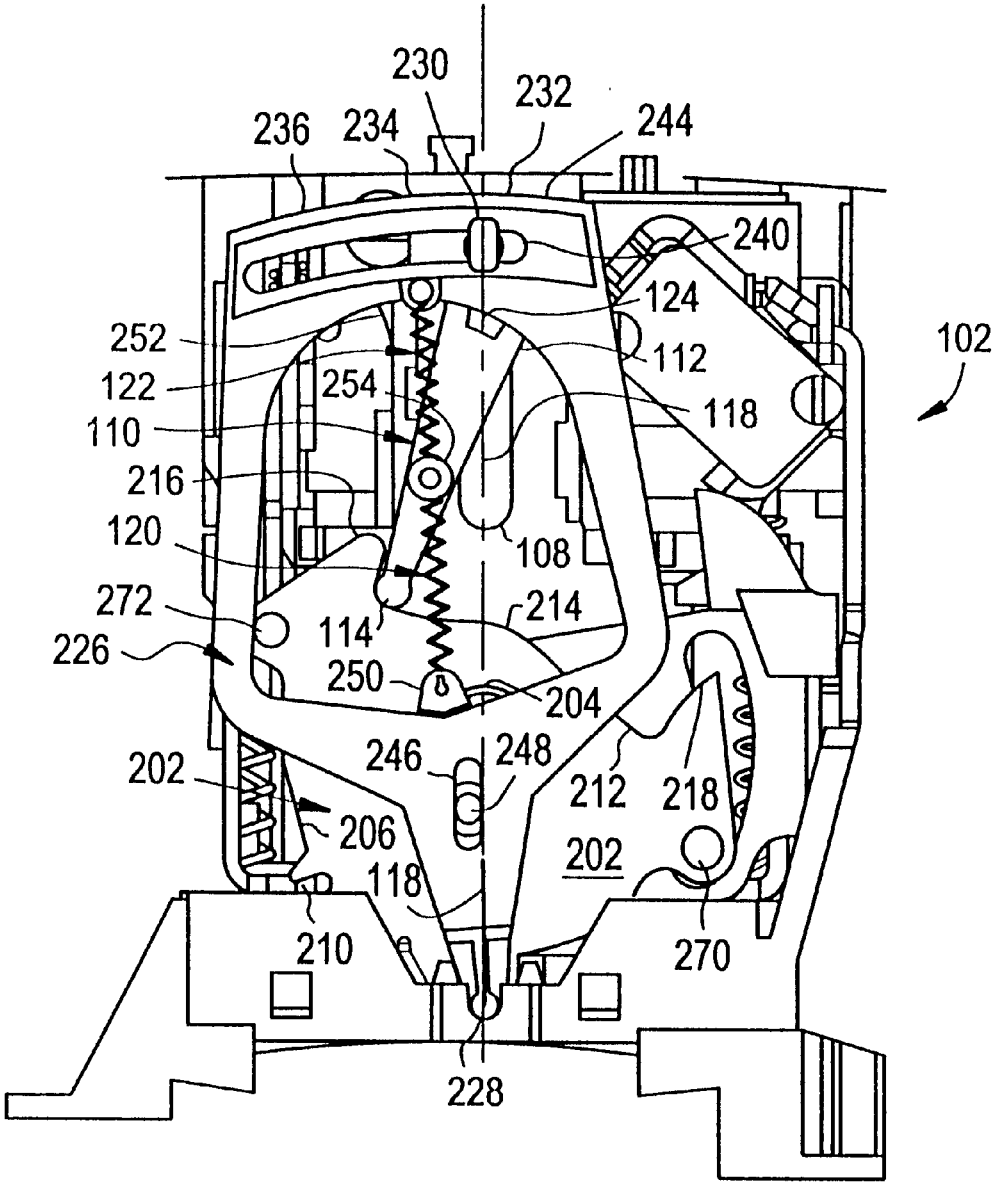
FIG. 10 is a right side view of the circuit breaker drive of FIG. 8.
Figure 11:
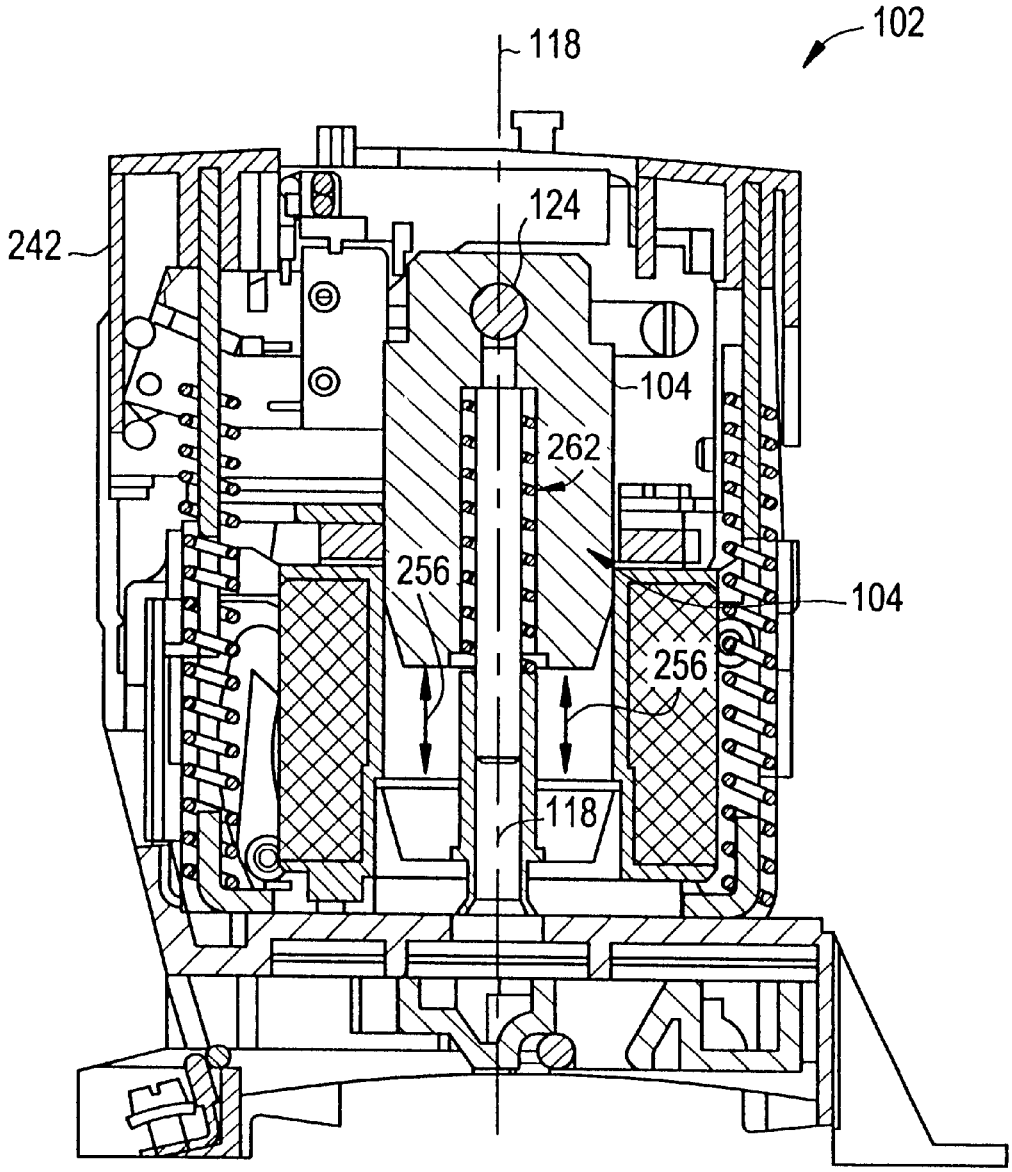
FIG. 11 is a sectional view of the circuit breaker drive of FIG. 8.

Referring now to FIGS. 7 through 16, a second embodiment of the drive 102 of the present invention is shown. In FIG. 7 the drive 102 is shown in three dimensional perspective view including a housing 242. As seen in FIGS. 8, 9 and 10, the drive 102 comprises a pair of cans 202 rotatable about the second axis 204. A pair of levers 110 having first and second ends 112, 114 thereof are rotatable about the first axis 124. The pair of levers 110 are pivotally coupled to the actuator 104 by way of the first axis 124. The first axis 124, and thus the pair of levers 110, are capable of translation along the slot 108 in response to the translational action of the actuator 104 as seen at 256 in FIG. 11. The lever 110 shown in FIG. 9 includes a set screw 126 to hold the lever 110 to the first axis 124. The actuator 104 translates downward due to the action of the solenoid 104. The actuator 104 translates upward under the impetus of a return spring 262.

Referring to FIG. 10, the drive 10 includes a position indicator 226 rotatable about an axis 228. The position indicator 226 is coupled to one of the pair of levers 110 by way of a coupling mechanism, such springs 120, 122. The springs 120, 122 are attached to the position indicator 226 at latches 250, 252 and to the lever 110 at latch 254. Along a surface 244 of the position indicator 226, a set of position graphics 232, 234, 236 is embossed or engraved thereon some appropriate manner. The position graphics are indicative of the position of the circuit breaker, i.e., OFF 232, TRIP 234 and ON 236. A guide 230 is disposed in a slot 240 of the position indicator 226 for guiding the position indicator 226. The cam 202 includes a pin 248 affixed thereto and disposed within a slot 246 in the position indicator 226. The pin 248 is operative to rotate the position indicator 226 in response to the motion of the cam 202.

As described above, the cam 202 includes a base 206 having a surface 208 and at least one surface 212 disposed substantially in opposition to the first surface 208 and culminating in an apex 214. In addition, a first and second flange 216, 218 extend from the base 206. The cam system 200 further comprises a rack 220, such as a slidable rack 220, coupled to the base 206 of the cam 202. The second end 114 of the lever 110 is disposed in a first position proximate the second surface 212 and the first flange 216.

Still further, the first surface 208 includes a first set of gear teeth 210 and the rack 220 includes a second set of gear teeth 222 mated to the first set of gear teeth 210. Furthermore, the circuit breaker operating mechanism 300 (shown in FIGS. 12–16) includes an operating handle 302 coupled to the rack 220 so as to aid in effecting the aforesaid reengagement of the circuit breaker contacts. The cams 202 further include first and second pins 270, 272 connecting the cams 202. The first pin 270 also connects the cams 202 to an "OFF" button 260 and the second pin 272 also connects the cams 202 to an "ON" button 258.

It will be appreciated from FIGS. 12–16 that the levers 110, the cam system 200 and the circuit breaker operating mechanism 300 may successively assume one of a plurality of configurations in response to the change in state of an electrical system (not shown) and to the action of solenoid 104 and the return spring 262.

Figure 12:
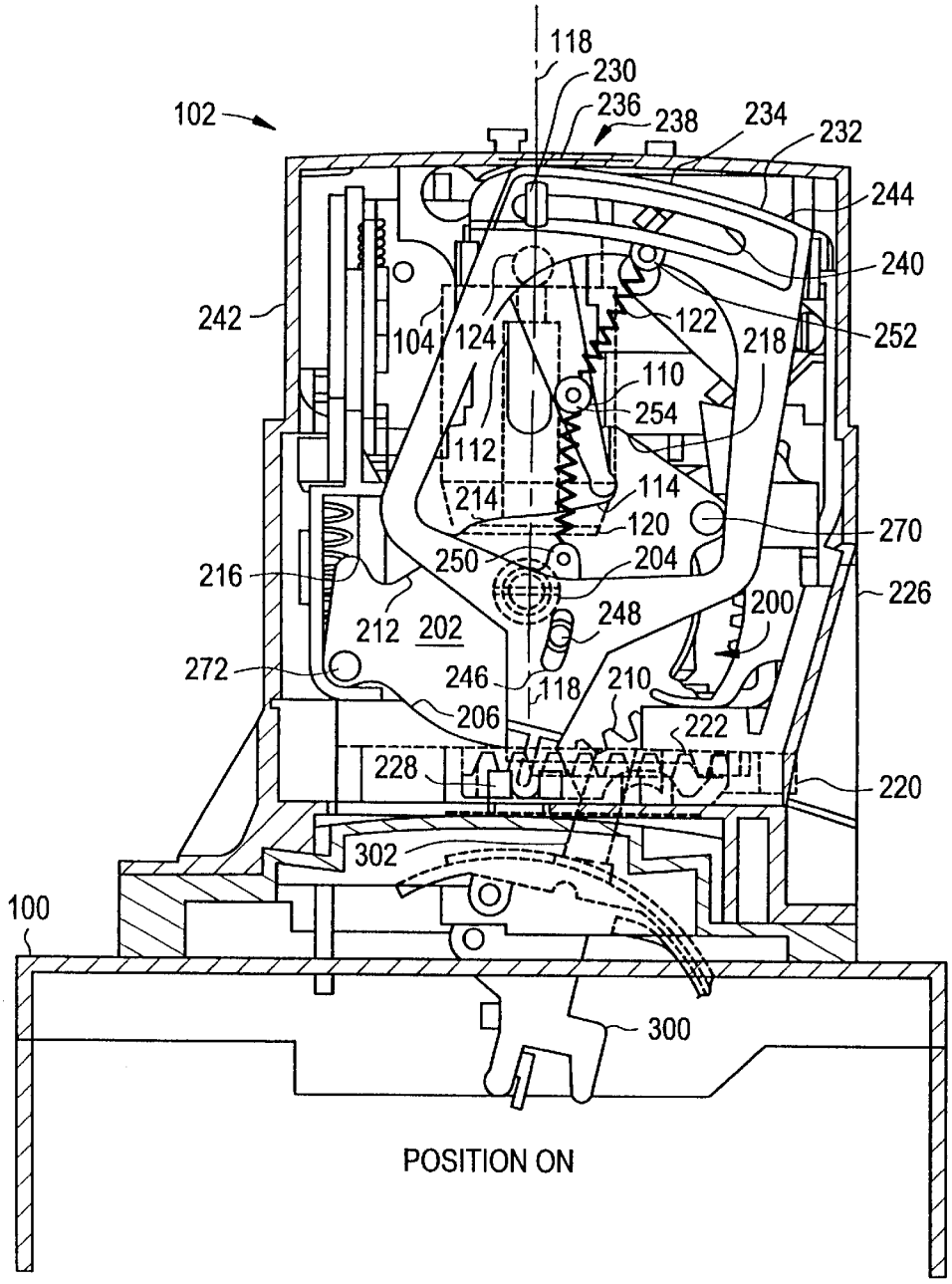
FIG. 12 is a side view of the circuit breaker drive of FIG. 8 in the ON position.

For example, in FIG. 12 the circuit breaker contacts are closed and the lever 110 is in an "up" position, positioned right of the centerline 118 as viewed. The second end 114 of the lever 110 is juxtaposed in close proximity to the second surface 212 and the second flange 218 whereby the cam 202, the position indicator 226 and the rack 220 are positioned right of the centerline 118 as viewed. This configuration is referred to as the "ON" position and is indicated by way of the ON position graphic 236 viewed through a view port 238 of the housing 242.

Figure 13:
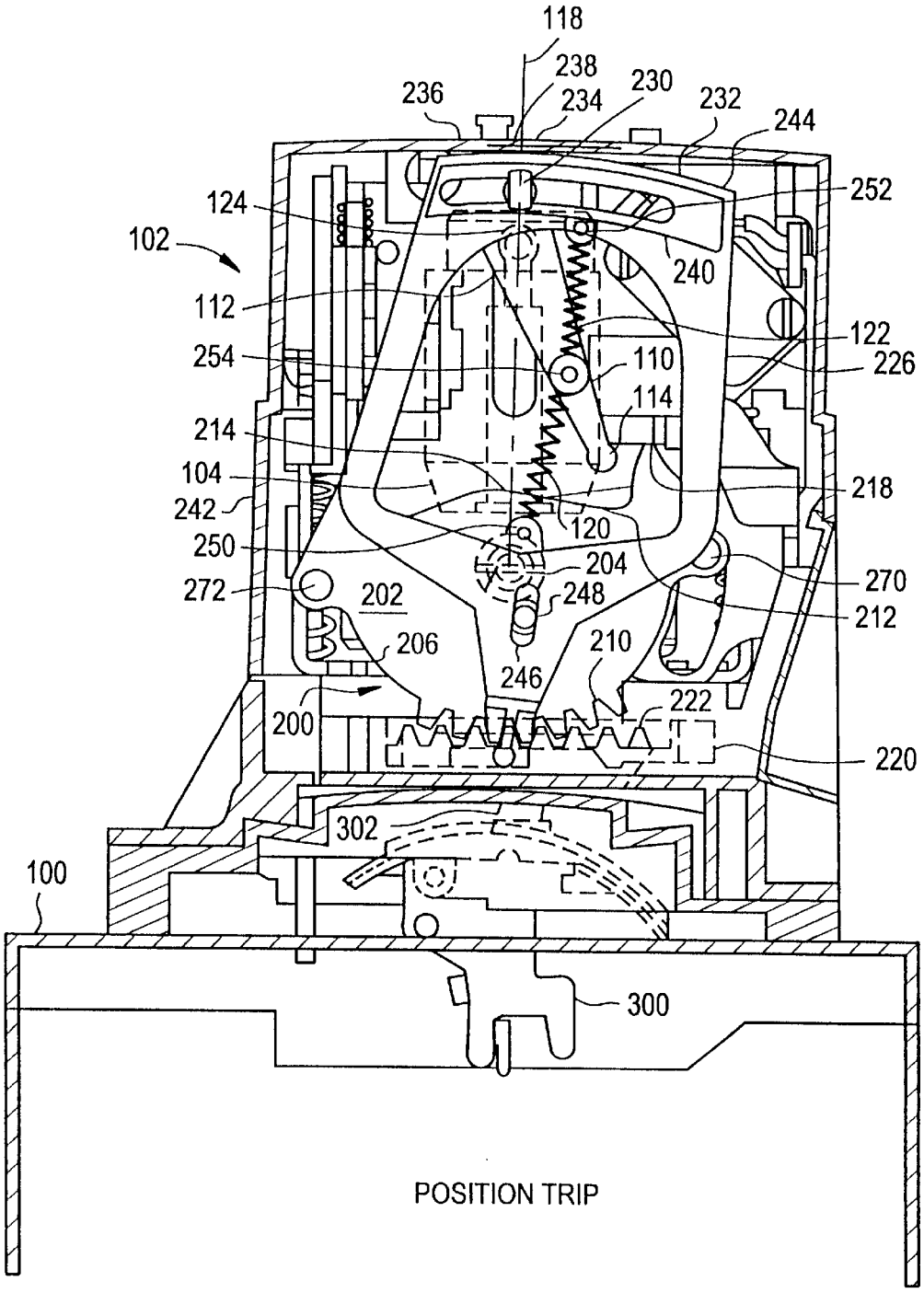
FIG. 13 is a side view of the circuit breaker drive of FIG. 8 in the TRIP position.

In FIG. 13, in response to a change in state of the electrical system, for instance an overcurrent condition in the electrical system, the operating mechanism 300 and the operating handle 302 rotate counterclockwise, as viewed, to open the contacts. This drives the rack 220 leftward and thus drives the cam 202 clockwise about axis 204. The clockwise rotation of the cam 202 in combination with pin 248 coupled to slot 246 rotates the position indicator 226 counterclockwise about the axis 228. This configuration is referred to as the "TRIP" position and is indicated by way of the TRIP position graphic 234 viewed through the view port 238 of the housing 242.

Figure 14:
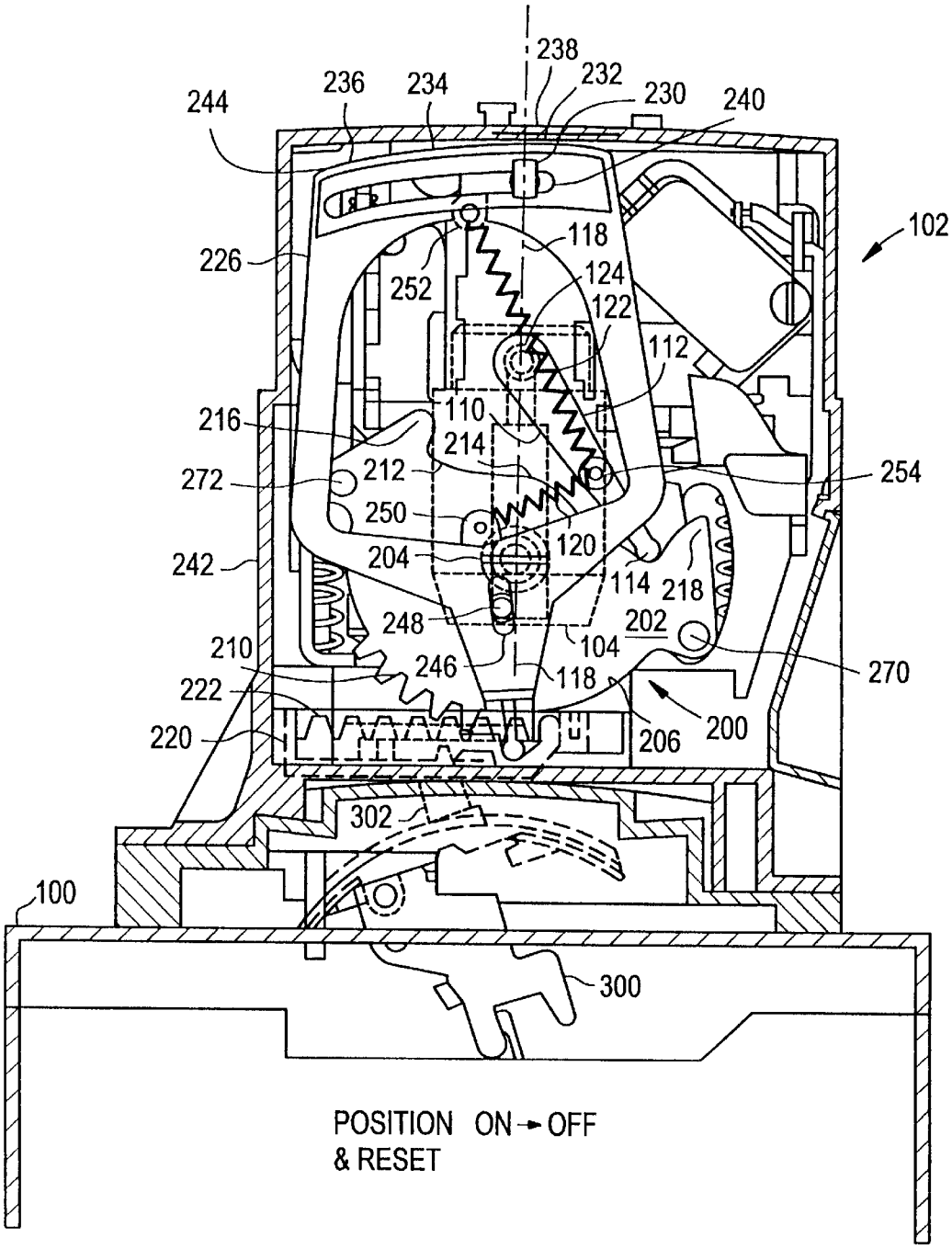
FIG. 14 is a side view of the circuit breaker drive of FIG. 8 in the ON-OFF and RESET positions.

In FIG. 14, in response to the action of the solenoid 104, the lever 110 is driven downward in the slot 108 thereby engaging the second surface 212 and the second flange 218 of the cam 202. This action causes the cam 202 to rotate clockwise about the axis 204, thus driving the rack 220 leftward as viewed and rotating the circuit breaker operating mechanism 300 further counterclockwise. The position indicator 226 rotates counterclockwise. This resets the circuit breaker operating mechanism 300 after a circuit breaker trip. This configuration is referred to as the "RESET" position and is indicated by way of the OFF position graphic 232 viewed through the view port 238 of the housing 242. This configuration is also referred to as the ON-OFF position representing the intermediate position of the drive 102 when the drive 102 is moving from the ON position to the OFF position.

Figure 15:
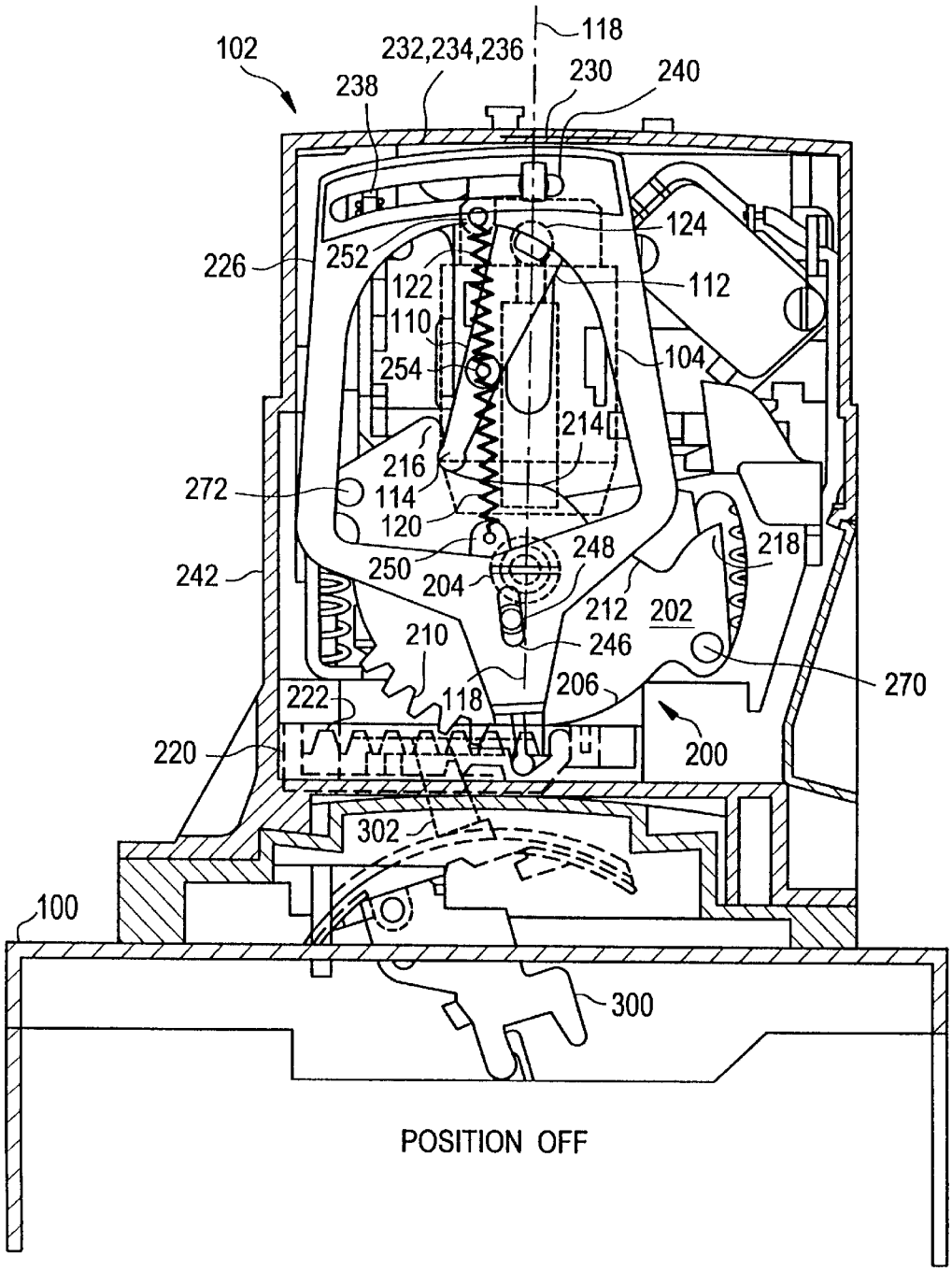
FIG. 15 is a side view of the circuit breaker drive of FIG. 8 in the OFF position.

In FIG. 15, in response to the action of the return spring 262, the lever 110 is driven upward along the slot 108 thereby positioning the lever 110 to the left of the centerline 118, as viewed. The second end 114 of the lever 110 is thereby juxtaposed in close proximity to the second surface 212 and the first flange 216. The circuit breaker contacts are now open. The position indicator 226 is maintained in the "OFF" position and is indicated by way of the OFF position graphic 232 viewed through the view port 238 of the housing 242.

Figure 16:
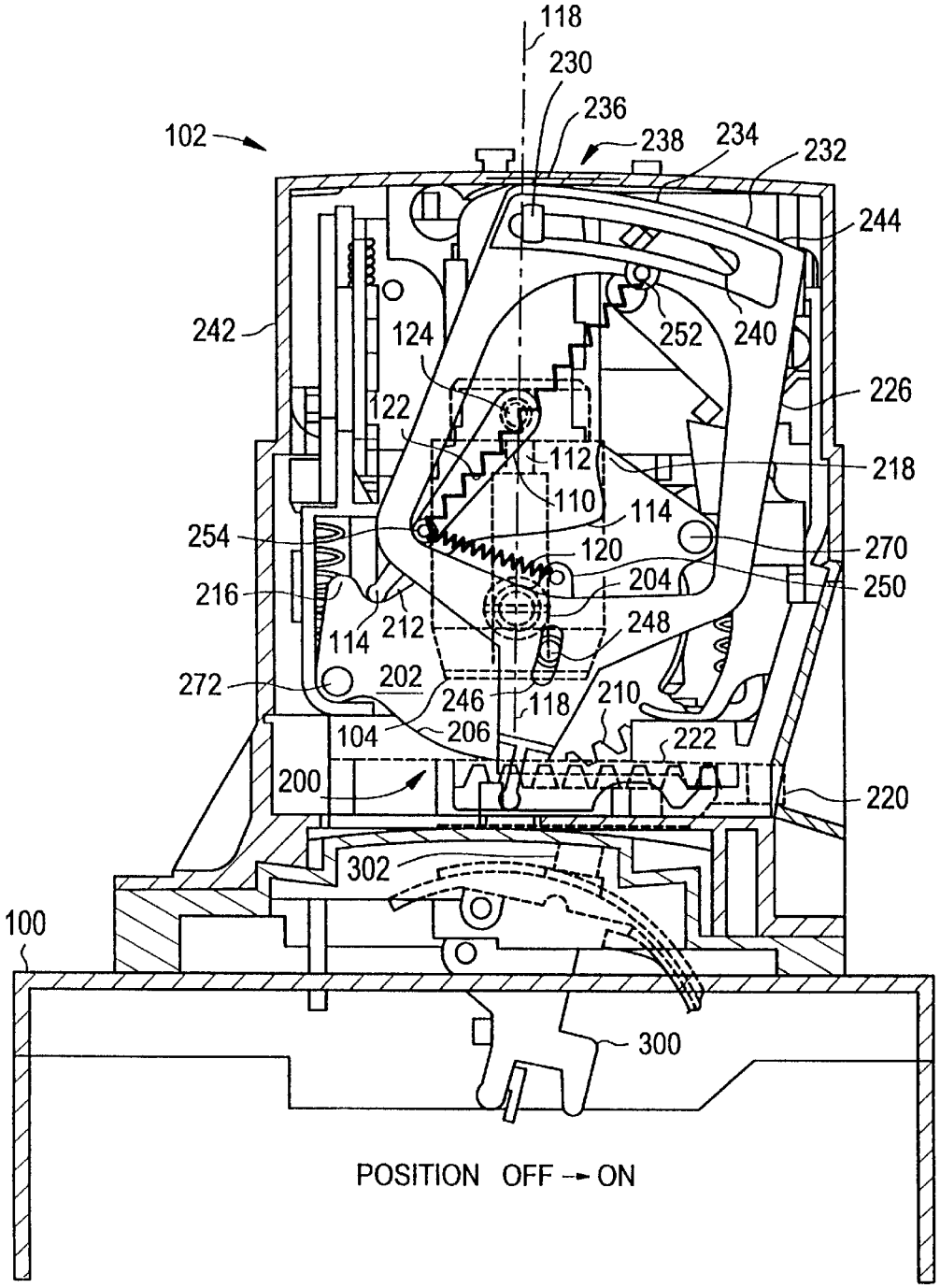
FIG. 16 is a side view of the circuit breaker drive of FIG. 8 in the OFF-ON position.

In FIG. 16, in response to the action of the solenoid 104, the lever 110 is driven downward in the slot 108 thereby causing the cam 202 to rotate counterclockwise, thus driving the rack 220 rightward as viewed, reengaging the circuit breaker contacts. The position indicator 226 rotates clockwise so that the ON position graphic 236 can be viewed through the view port 238 of the housing 242.

The lever 110, the cam system 200 and the circuit breaker operating mechanism 300 are returned to the initial configuration of FIG. 12 when the lever 110 is driven upward in the slot 108 by the action of the return spring 262. The cam system 200 and the circuit breaker operating mechanism 300 return to their initial configuration before the lever 110 is moved upward.

It will be appreciated that the drive 102 can be manually operated to proceed from the "ON" position of FIG. 12, with circuit breaker contacts closed, to the "OFF" position of FIG. 15, to open the circuit breaker contacts. In particular, the "OFF" button 200 may be manually depressed while the drive 102 is in the "ON" position of FIG. 12. This action rotates the cam 202 clockwise and the position indicator 226 counterclockwise, thus disengaging the circuit breaker contacts while positioning the lever 110 left of the centerline 118 and proximate the first flange 216. This brings the drive to the "OFF" position of FIG. 15. To return to the "ON" position of FIG. 12, the "ON" button 258 is depressed manually. This action rotates the cam 202 counterclockwise, thus reengaging the circuit breaks contacts while returning the lever 110 to a position right of the centerline 118 and proximate the second flange 218.

In addition, when the drive 102 is initially in the "ON" position of FIG. 12, the circuit breaker operating mechanism 300 trips and drives the drive 102 to "TRIP" position of FIG. 13. The drive 102 is reset by the action of the solenoid 104 and brought to the "RESET" position of FIG. 14. The drive 102 is then brought to the "OFF" position of FIG. 15 by the return of the solenoid 104. To return to the "ON" position of FIG. 12, the "ON" button 258 is manually depressed as described above. This action rotates the cam 202 counterclockwise, thus reengaging the circuit breaker contacts while returning the lever 10 to a position right of the centerline 118 and proximate the second flange 218.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A circuit breaker drive comprising:

an actuator for assuming a plurality of positions;

a lever coupled to the actuator and responsive to the action of the actuator;

a cam rotatable about an axis, the cam juxtaposed proximate the lever, the lever operative to rotate the cam about the axis; and a rack coupled to the cam and to an operating handle of the circuit breaker, rotation of the cam about the axis drives the rack to move the operating handle.

2. The circuit breaker drive as set forth in claim 1 further comprising a position indicator rotatable about an axis of rotation and operative thereby to assume a plurality of positions; and a coupling mechanism for coupling the position indicator to the lever.

3. The circuit breaker drive as set forth in claim 2 wherein the position indicator includes a plurality of position graphics indicative of the position of the circuit breaker.

4. The circuit breaker drive as set forth in claim 2 wherein the coupling mechanism is a spring.

5. The circuit breaker drive as set forth in claim 1 wherein the actuator is a solenoid.

6. The circuit breaker drive as set forth in claim 1 wherein the cam comprises:

a base including a first surface and at least one second surface disposed substantially in opposition to the first surface;

a first flange extending from the base; and a second flange extending from the base on an opposite side of the at least one second surface from the first flange.

7. The circuit breaker drive as set forth in claim 6 wherein the first surface is a geared surface.

8. The circuit breaker of claim 1 wherein the rack is a geared rack.

9. The circuit breaker drive as set forth in claim 1 wherein the at least one second surface comprises:

a second surface adjoining the first flange; and a third surface adjoining the second flange and adjoining the second surface at an apex.

10. The circuit breaker drive as set forth in claim 1 further comprising:

a spring extending between the lever and the rack, the spring biases the lever to a first side of the axis when the rack is in a first position, and the spring biases the lever to a second side of the axis when the rack is in a second position.

11. A circuit breaker including:

a housing;

an operating handle extending from the housing; and a drive coupled to the operating handle, the drive comprising:

an actuator, a lever pivotally coupled to the actuator, a cam rotatable about an axis, the cam juxtaposed proximate the lever, the lever is operative to rotate the cam about the axis, and a rack coupled to the cam and the operating handle, rotation of the cam about the axis drives the rack to move the operating handle.

12. The circuit breaker as set forth in claim 11 wherein the cam comprises:

a base including a first surface and at least one second surface disposed substantially in opposition to the first surface;

a first flange extending from the base; and a second flange extending from the base on an opposite side of the at least one second surface from the first flange.

13. The circuit breaker as set forth in claim 12 wherein the first surface is a geared surface and the rack is a geared rack.

14. The circuit breaker as set forth in claim 11 further including:

a position indicator rotatable about an axis of rotation and operative thereby to assume a plurality of positions; and a coupling mechanism for coupling the position indicator to the lever.

15. The circuit breaker as set forth in claim 14, wherein the coupling mechanism is a spring.

16. The circuit breaker as set forth in claim 11 wherein the actuator is a solenoid.

17. The circuit breaker as set forth in claim 11 further comprising:

a spring extending between the lever ad the rack, the spring biases the lever to a first side of the axis when the rack is in a first position, and the spring biases the lever to a second side of the axis when the rack is in a second position.

18. A drive for moving a handle of a circuit breaker between an ON position and an OFF position, the drive comprising:

cam rotatable about an axis, a rack coupled to the cam and to the operating handle, rotation of the cam about the axis drives the rack to move the operating handle between the ON position and the OFF position, a lever juxtaposed proximate the cam, the lever includes an end for driving the cam about the axis, a spring extending between the rack and the lever, the spring biases the end of the lever to a first side of the axis when the rack is the ON position, and the spring biases the end of the lever to a second side of the axis when the rack is in the OFF position.

19. The drive of claim 18, further comprising:

a position indicator rotatable about an axis; and a spring for coupling the position indicator to the lever.

20. The drive of claim 18 wherein the cam includes a geared surface meshed with a geared surface on the rack.

21. The drive of claim 18 further comprising:

an actuator coupled to the lever, the actuator forces the lever to drive the cam about the axis.

* * * * *